US010734755B2

(12) United States Patent
DeWitte et al.

(10) Patent No.: US 10,734,755 B2
(45) Date of Patent: Aug. 4, 2020

(54) ELECTRICAL CONNECTOR AND CONNECTOR ASSEMBLY HAVING A SEAL GLAND

(71) Applicant: TE CONNECTIVITY CORPORATION, Berwyn, PA (US)

(72) Inventors: Thomas Robert DeWitte, Shelby Township, MI (US); David James Rhein, Memphis, MI (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/140,173

(22) Filed: Sep. 24, 2018

(65) Prior Publication Data

US 2020/0099164 A1 Mar. 26, 2020

(51) Int. Cl.

| | |
|---|---|
| ***H01R 13/53*** | (2006.01) |
| ***H01R 13/52*** | (2006.01) |
| ***H01R 13/62*** | (2006.01) |
| ***H01R 43/26*** | (2006.01) |
| ***H01R 13/03*** | (2006.01) |

(52) U.S. Cl.

CPC ..... *H01R 13/53* (2013.01); *H01R 13/03* (2013.01); *H01R 13/5216* (2013.01); *H01R 13/5219* (2013.01); *H01R 13/62* (2013.01); *H01R 43/26* (2013.01)

(58) Field of Classification Search

CPC .... H01R 13/53; H01R 13/03; H01R 13/5216; H01R 13/5219; H01R 13/62; H01R 43/26

USPC ..... 439/281, 271–280, 282, 283

See application file for complete search history.

(56) References Cited

U.S. PATENT DOCUMENTS

| | | | | |
|---|---|---|---|---|
| 4,521,064 A * | 6/1985 | Knapp | H01R 13/5219 | 439/153 |
| 4,639,061 A * | 1/1987 | Muzslay | H01R 13/5221 | 439/281 |
| 4,936,791 A * | 6/1990 | Zielinski | H01R 13/5219 | 439/271 |
| 4,946,402 A * | 8/1990 | Fink | H01R 13/5221 | 439/274 |
| 5,358,420 A | 10/1994 | Cairus et al. | | |
| 5,906,499 A * | 5/1999 | Sikora | H01R 13/5221 | 439/271 |

(Continued)

OTHER PUBLICATIONS

International Search Report, International Application No. PCTIB2019/057849 International Filing Date, Sep. 18, 2019.

*Primary Examiner* — Travis S Chambers

(57) ABSTRACT

Electrical connector includes an electrical contact coupled to a connector body and configured to engage a respective contact of a mating connector. The electrical connector includes a seal gland secured to the connector body. The seal gland is shaped to engage the mating connector during the mating operation. The seal gland includes a lubricating section and a sealing section that are displaceable by the mating connector during the mating operation. The lubricating section is positioned in front of the sealing section such that the lubricating section initially engages the mating connector. The lubricating section has at least one of an added lubricant or an intrinsic lubricant. The seal gland is configured to provide a first frictional force as the mating connector engages the lubricating section and a second frictional force as the mating connector engages the sealing section. The second frictional force is greater than the first frictional force.

21 Claims, 7 Drawing Sheets

(56) References Cited

U.S. PATENT DOCUMENTS

| | | | | |
|---|---|---|---|---|
| 6,045,383 | A * | 4/2000 | Fujiwara | H01R 13/5219 439/271 |
| 6,053,754 | A * | 4/2000 | Kano | H01R 13/5221 439/281 |
| 6,244,886 | B1 * | 6/2001 | Strang | H01R 13/5202 439/271 |
| 9,431,749 | B2 | 8/2016 | Mingo et al. | |
| 9,450,327 | B1 * | 9/2016 | Madinabeitia | H02G 3/083 |
| 2011/0207368 | A1 * | 8/2011 | Takada | H01R 13/521 439/519 |
| 2013/0065458 | A1 * | 3/2013 | Frank | H01R 13/111 439/834 |
| 2013/0130530 | A1 * | 5/2013 | Casses | H01R 13/5219 439/271 |
| 2016/0190719 | A1 | 6/2016 | Brzezinski et al. | |

* cited by examiner

ELECTRICAL CONNECTOR AND CONNECTOR ASSEMBLY HAVING A SEAL GLAND

BACKGROUND

The subject matter herein relates generally to an electrical connector having one or more electrical contacts that is configured to mate with another electrical connector.

Electrical connectors may be used to transfer data and/or electrical power between different systems or devices. Electrical connectors are often designed to operate in challenging environments where contaminants, shock, and/or vibration can disrupt the electrical connection. For example, automobiles and other machinery utilize electrical connectors to communicate data and/or electrical power therein. At least some known electrical connector assemblies include a receptacle connector having a cavity configured to receive a header connector. The cavity opens to a front end of the receptacle connector and extends a depth into the receptacle connector. The receptacle connector may include a set of electrical contacts. The header connector typically includes a complementary set of electrical contacts that are configured to engage the electrical contacts of the receptacle connector.

As the receptacle and header connectors are engaged during a mating operation, surfaces of the respective electrical contacts engage each other, thereby generating friction. Surfaces of other portions of the receptacle and header connectors may also engage each other, thereby generating additional friction. The friction between the different surfaces resists the mating operation. Customers and/or industry standards may require that a maximum mating force not exceed a certain limit during the mating operation, such as 75 newtons. Such requirements may be difficult to achieve and/or may cause other design limitations. For example, a tool (e.g., lever or slide mechanism) for driving the mating operation may be necessary for some connector assemblies. Such tools occupy space, add weight, and are typically more costly. Other design limitations may include a number of electrical contacts that can be used without exceeding the maximum mating force.

Accordingly, there is a need for an electrical connector and electrical connector assembly that reduces the mating force for mating two electrical connectors.

BRIEF DESCRIPTION

In an embodiment, an electrical connector is provided that includes a connector body having a leading end that is configured to mate with a mating connector. The connector body and the mating connector are configured to align with an alignment axis and move relatively along the alignment axis toward each other during a mating operation. The electrical connector also includes an electrical contact coupled to the connector body and configured to engage a respective contact of the mating connector during the mating operation. The electrical connector also includes a seal gland secured to the connector body. The seal gland is shaped to engage the mating connector during the mating operation. The seal gland includes a lubricating section and a sealing section that are displaceable by the mating connector during the mating operation. The lubricating section is positioned in front of the sealing section such that the lubricating section initially engages the mating connector. The lubricating section has at least one of an added lubricant or an intrinsic lubricant. The seal gland is configured to provide a first frictional force as the mating connector engages the lubricating section and a second frictional force as the mating connector engages the sealing section. The second frictional force is greater than the first frictional force.

In some aspects, the electrical connector further comprises a contact array that includes the electrical contact and additional electrical contacts.

In some aspects, the seal gland includes a series of alternating ridges and grooves. Optionally, the lubricating section includes a leading ridge of the series of alternating ridges and grooves and the sealing section includes an interior ridge of the series of alternating ridges and grooves. The leading ridge and the interior ridge are adjacent to each other with one of the grooves therebetween, wherein the leading ridge has a radial height that is less than a radial height of the interior ridge. Also optionally, the seal gland is disposed along an exterior of the electrical connector and extends away from a surface of the connector body.

In some aspects, the lubricating section includes a gland finger that extends away from a surface of the connector body and defines a leading ridge. The gland finger is deflectable in a direction at least partially along the alignment axis such that the ridge is displaced at least partially along the alignment axis.

In some aspects, the seal gland includes a unitary piece of material in which the sealing section and the lubricating section are portions of the unitary piece of material. The sealing section has at least one of the added lubricant or the intrinsic lubricant. Optionally, the lubricant is intrinsic with the unitary piece of material.

In some aspects, the electrical connector is devoid of an integrated tool for driving the mating operation.

In some aspects, the lubricating section has an engagement surface that engages the mating connector and the electrical contact has an engagement surface that engages the mating connector. The engagement surface of the lubricating section is positioned in front of the engagement surface of the electrical contact.

In some aspects, a maximum mating force for mating the mating connector and the electrical connector having the seal gland is less than a maximum mating force for mating the mating connector and the electrical connector devoid of the lubricating section.

In some aspects, the seal gland at least partially surrounds the alignment axis.

In some aspects, the electrical connector is a high-voltage connector having an operating voltage of at least 48 volts (V).

In an embodiment, an electrical connector assembly is provided that includes an electrical connector including a connector body having a leading end and an electrical contact coupled to the connector body. The electrical connector assembly also includes a mating connector configured to mate with the electrical connector such that the electrical contact and a respective contact of the mating connector engage each other during the mating operation. The connector body and the mating connector are configured to align with an alignment axis and move relatively along the alignment axis toward each other during the mating operation. The electrical connector assembly also includes a seal gland disposed between respective surfaces of the electrical connector and the mating connector when fully mated. The seal gland includes a lubricating section and a sealing section that are displaceable during the mating operation. The lubricating section is positioned in front of the sealing section such that the lubricating section is displaced prior to the sealing section being displaced during the mating operation. The lubricating section has at least one of an added lubricant or an intrinsic lubricant, wherein the lubricating section reduces a maximum mating force for mating the mating connector and the electrical connector. Optionally, a maximum mating force during the mating operation is at most 75 newtons (N).

DETAILED DESCRIPTION

Figure 1:
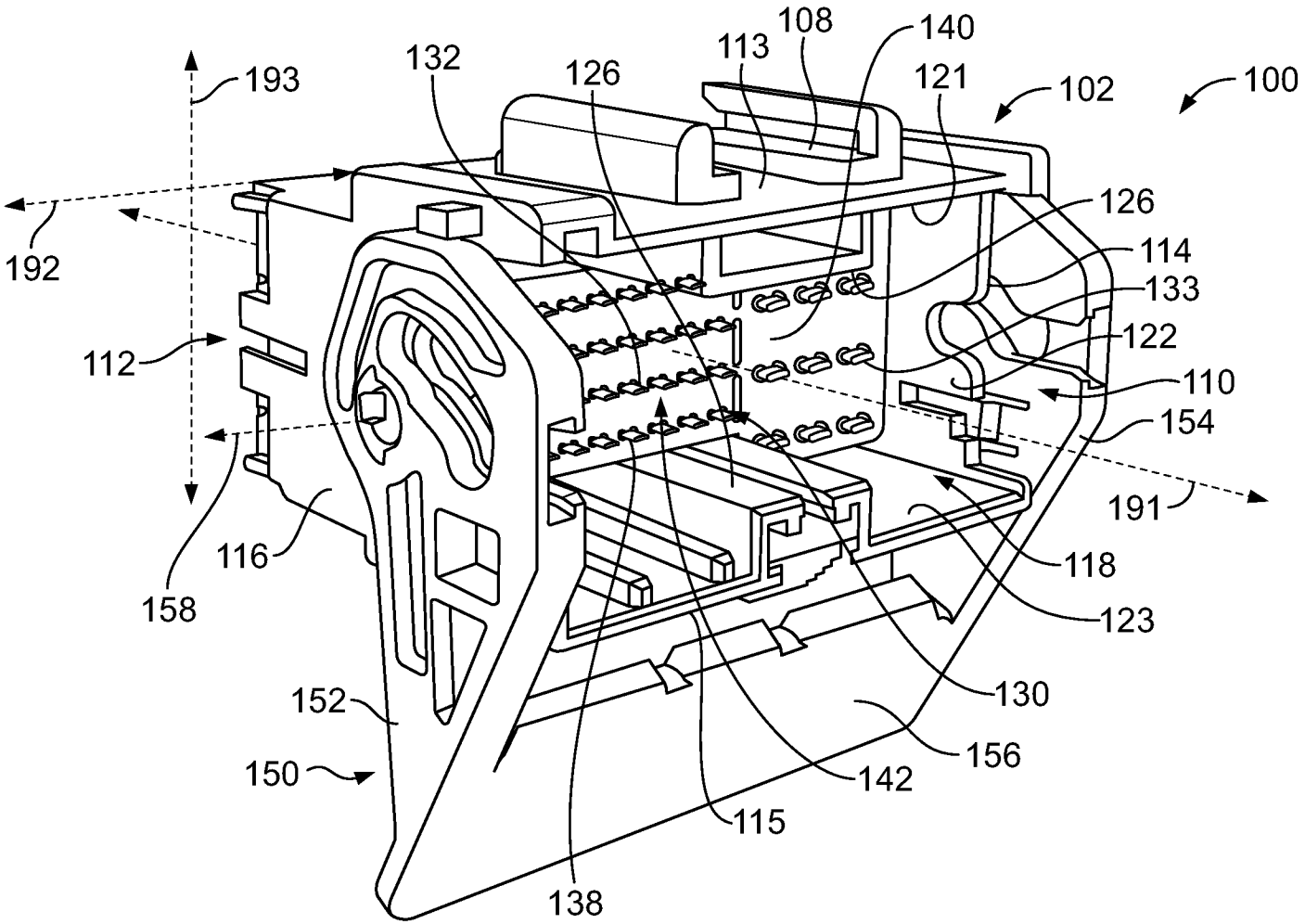
FIG. 1 is a perspective view of a receptacle connector in accordance with an embodiment.

Embodiments set forth herein include electrical connectors and electrical connector assemblies having seal glands. The seal glands are disposed between surfaces of two electrical connectors when the electrical connectors are fully mated. As described herein, the seal glands include a lubricating section and a sealing section. The sealing section is configured to block or reduce an amount of unwanted material (e.g., dirt, contaminants, fluid, and the like) from entering the interface between the connectors and possibly disrupting electrical communication. The lubricating section is configured to reduce a maximum mating force for mating the two connectors. For instance, a maximum mating force for mating the two electrical connectors, wherein at least one of the electrical connectors includes the seal gland, may be less than a maximum mating force for mating the two electrical connectors when devoid of the lubricating section. By way of example, the maximum mating force may be at most 50 newtons (N) or at most 75 N. In particular embodiments, the maximum mating force may be at most 100 N. However, it should be understood that the maximum mating force may be less than 50 N or more than 100 N in other embodiments.

Embodiments may be configured for communicating data signals and/or electrical power. In particular embodiments, the electrical connector assembly is a high-voltage electrical connector assembly. For example, an operating voltage (e.g., voltage that the electrical connector assembly may operate at for a commercially reasonable period of time) may be at least 40 volts (V) or at least 48 V. In some embodiments, the operating voltage may be at least 100 V or at least 150 V. In some embodiments, the operating voltage may be at least 200 V. In certain embodiments, the operating voltage may be at least 500 V or at least 600 V. Embodiments may be designed to satisfy one or more standards and specifications, such as AK 4.3.3; LV215-1; and/or RoHS.

In particular embodiments, the electrical connector or electrical connector assemblies are tool-less devices such that the electrical connector or the electrical connector assembly is devoid of an integrated tool for driving the mating operation. Such integrated tools typically include a lever or a slider or other mechanism that provides leverage for driving the mating operation.

Figure 2:
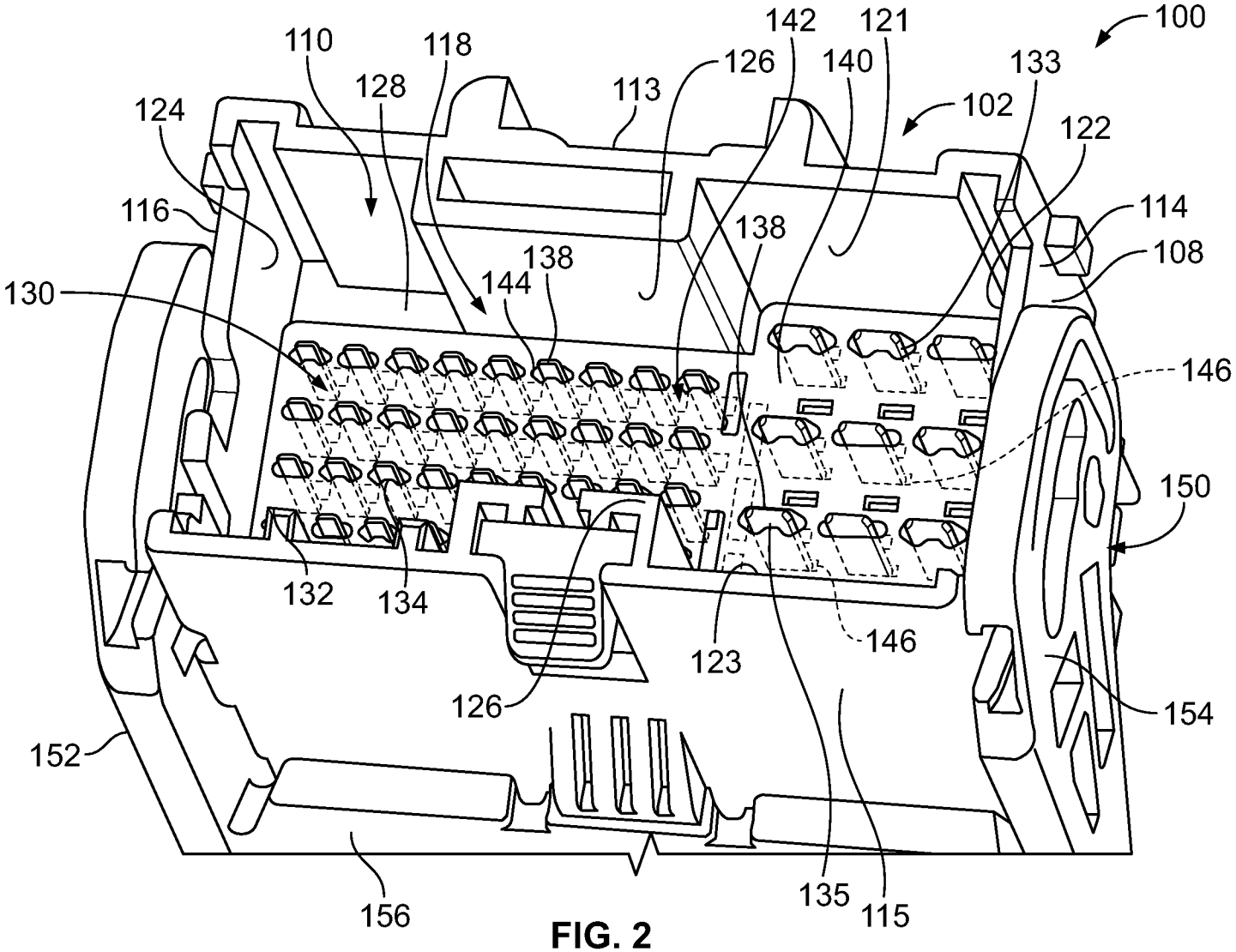
FIG. 2 is another perspective view of the receptacle connector shown in FIG. 1.

FIGS. 1 and 2 illustrate different perspective views of an electrical connector 100 formed in accordance with an embodiment. The electrical connector 100 includes a connector body 102 is configured to engage an electrical connector 106 (shown in FIG. 3) during a mating operation. For clarity, one of the electrical connectors 100, 106 may be referred to as a "mating connector." Alternatively, the electrical connectors 100, 106 may be referred to as first and second electrical connectors 100, 106, respectively.

The connector body 102 includes a connector housing 108 having a front end 110 and a back wall 112 (FIG. 1) that face in generally opposite directions. The connector housing 108 also includes housing sides 113, 114, 115, 116 that extend between the front end 110 and the back wall 112. As shown in FIG. 1, the electrical connector 100 is oriented with respect to mutually perpendicular axes, including an alignment axis 191, a first lateral axis 192, and a second lateral axis 193. Although the electrical connector 100 shown in FIGS. 1 and 2 has a particular orientation, the electrical connector 100 is not limited to a particular orientation during operation.

The connector housing 108 defines a receiving cavity 118 that opens to the front end 110. The receiving cavity 118 is sized and shaped to receive the electrical connector 106 (FIG. 3) during the mating operation. During the mating operation, the electrical connector 100 and the electrical connector 106 are moved, relative to one another, such that the electrical connector 106 is received within the receiving cavity 118. For example, the electrical connector 106 and the electrical connector 100 may be positioned to face each other and aligned along the alignment axis 191. The electrical connector 106 may be inserted into the receiving cavity 118 as the electrical connector 100 is held in a stationary position. Alternatively, the electrical connector 106 may be stationary as the electrical connector 100 is moved such that the electrical connector 106 is received within the receiving cavity 118. In other embodiments, both the electrical connector 106 and the electrical connector 100 are moved during the mating operation.

Figure 3:
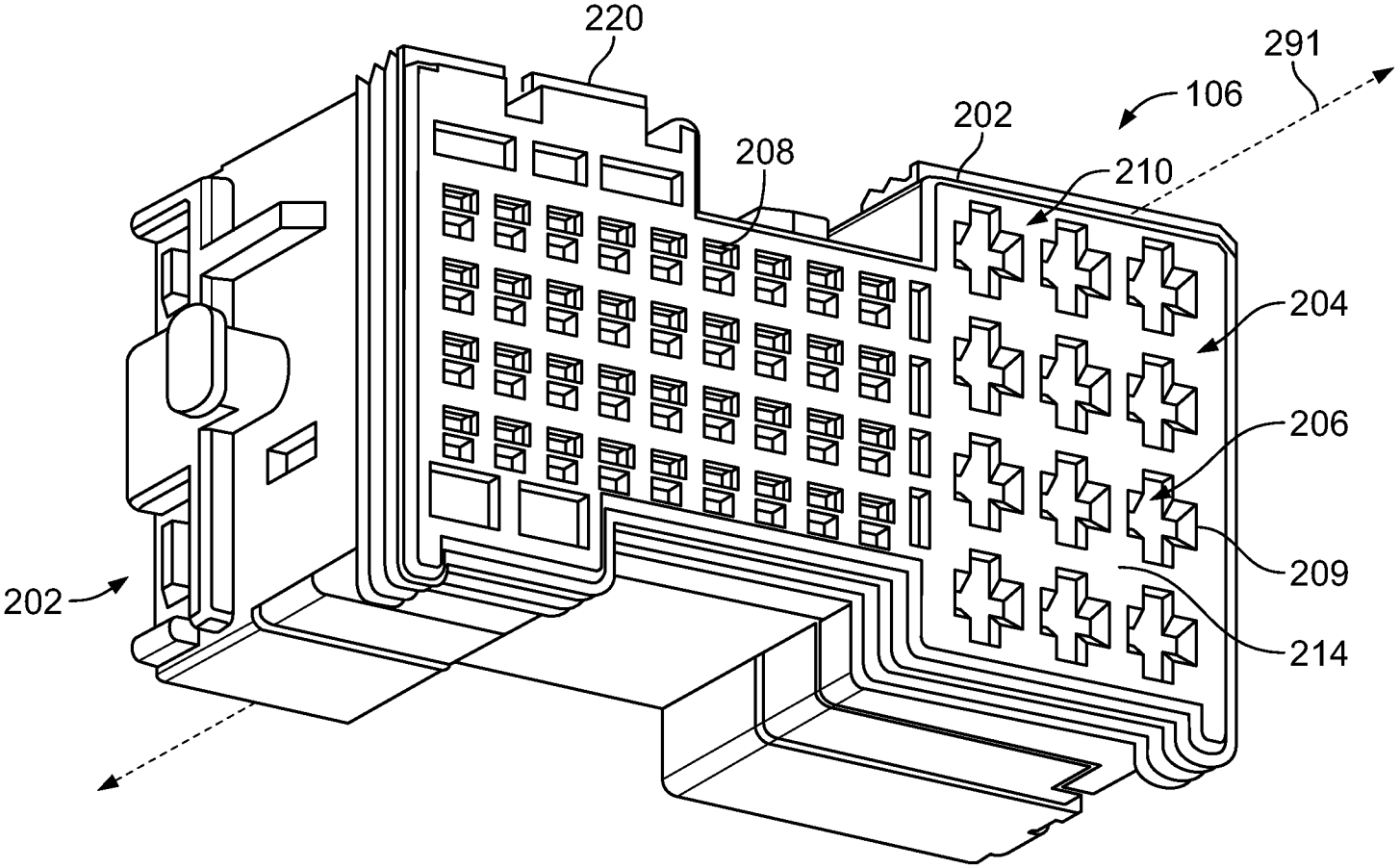
FIG. 3 is a perspective view of an electrical connector that may engage the receptacle connector of FIG. 1.

The connector housing 108 includes interior sidewalls 121, 122, 123, and 124 that define the receiving cavity 118. The sidewall 124 is shown in FIG. 2. In the illustrated embodiment, the interior sidewalls 121-124 are shaped to include keying features 126. The keying features 126 may assure that the electrical connector 100 and the electrical connector 106 are properly oriented with respect to one another during the mating operation. The receiving cavity 118 may also be defined by an interior rear wall 128 (FIG. 2). The interior sidewalls 121-124 generally face toward the central axis 191. The rear wall 128 faces in a direction along the central axis 191. In some embodiments, each of the interior sidewalls 121-124 may interface with the electrical connector 106 (FIG. 3).

The electrical connector 100 includes a contact array 130 of electrical contacts 132, 133 that are disposed within the receiving cavity 118. The electrical contacts 132, 133 include respective elongated bodies 134, 135 (shown in FIG. 2) that extend generally parallel to the central axis 191 and to one another. The elongated bodies 134, 135 extend from the rear wall 128 (FIG. 2) to a respective distal tip 138.

Optionally, the electrical connector 100 may include a movable guard 140 that is slidably coupled to the connector body 102. The movable guard 140 is configured to protect the contact array 130 prior to the mating operation. For example, the movable guard 140 may shield the electrical contacts 132, 133 from objects that inadvertently enter the receiving cavity 118. In some embodiments, the movable guard 140 may align and/or hold the electrical contacts 132, 133 in designated positions to reduce the likelihood of stubbing during the mating operation. Optionally, the movable guard 140 may be configured to function as a cover that reduces the likelihood of contaminants (e.g., dust) entering the receiving cavity 118. The movable guard 140 is configured to be held at a designated forward position, as shown in FIGS. 1 and 2, and move to a deeper position (shown in FIG. 7) during the mating operation. The movable guard 140 may remain within the receiving cavity 118 during the lifetime operation of the electrical connector 100. As shown, the movable guard 140 may include an array 142 of thru-holes 144. The array 142 is patterned to match the contact array 130 such that the electrical contacts 132, 133 extend through the thru-holes 144. In other embodiments, however, the electrical connector 100 may not include a movable guard 140.

The electrical connector 100 may be constructed in various manners. For example, in some embodiments, the electrical contacts 132, 133 are inserted through passages 146 (FIG. 2) of the back wall 112 that open to the receiving cavity 118 along the rear wall 128. The electrical contacts 132, 133 are advanced through the passages 146 into the receiving cavity 118 in a direction that is parallel to the central axis 191. For those embodiments that include the movable guard, the movable guard 140 may be disposed within the receiving cavity 118 prior to inserting the electrical contacts 132, 133. As the electrical contacts 132, 133 are inserted through the back wall 112 and the rear wall 128, the distal tip 138 of the electrical contacts 132, 133 is inserted through corresponding thru-holes 144. In other embodiments, the movable guard 140 may be positioned within the receiving cavity 118 after the electrical contacts 132, 133 are assembled into the contact array 130. For instance, each and every electrical contact 132, 133 may be operably positioned for engaging a corresponding mating contact of the electrical connector 106. The movable guard 140 may then be disposed within the receiving cavity 118 such that the thru-holes 144 receive the corresponding electrical contacts 132, 133.

In the illustrated embodiment, the electrical connector 100 includes a latching actuator 150 that is configured to engage the electrical connector 106 and couple the electrical connector 106 and the electrical connector 100 to each other such that the electrical connector 106 and the electrical connector 100 remain secured to each other during operation. The latching actuator 150 may include a pair of rotatable levers 152, 154 and an operator-controlled panel 156 that extends between and joins the rotatable levers 152, 154. In FIG. 1, the latching actuator 150 is shown in a first rotational position. In FIG. 2, the latching actuator 150 is shown in a second rotational position. To move to the second rotational position, the latching actuator 150 may be rotated about an axis of rotation 158 (FIG. 1) such that the operator-controlled panel 156 is positioned adjacent to the housing side 115 as shown in FIG. 2. As described in greater detail below, the latching actuator 150 moves the electrical connector 106 further into the receiving cavity 118 when the latching actuator 150 is rotated.

The electrical connector 100 and the electrical connector 106 (FIG. 3) may be wire-to-wire connector assemblies that each couple to and hold a bundle of wires. For example, the electrical contacts 132, 133 may be electrically coupled to or be parts of insulated wires 195 (shown in FIG. 5). The insulated wires 195 may include insulative jackets 196 (shown in FIG. 5) and wire conductors (not shown) that extend along a length of the corresponding wire. When the electrical connector 100 and the electrical connector 106 are mated, each insulated wire 195 may be electrically coupled, through the corresponding electrical contacts, to a corresponding insulated wire (not shown) of the electrical connector 106. As such, the electrical connector 100 and the electrical connector 106 electrically connect different bundles of wires. In some embodiments, the electrical connector 100 and the electrical connector 106 are not secured to a structure such that the mated connectors (i.e., the electrical connector 100 and the electrical connector 106 secured to each other) are free-floating. In such embodiments, the mated connectors may be moved when either of the wire bundles is pulled.

FIG. 3 is a perspective view of the electrical connector 106. The electrical connector 106 includes a connector body 202 having a connector housing 204. The connector housing 204 may be shaped (e.g., molded and/or printed) using a dielectric material. The connector body 202 includes the connector housing 204 and, optionally, additional parts that are coupled to the connector housing 204, such as other housing sections, shields, gaskets, etc. The connector body 202 has a leading end 210 and a trailing end 212. An alignment axis 291 extends through the connector body 202 between the leading and trailing ends 210, 212. The connector body 202 has a front face 214 that may be configured to engage the electrical connector 100 (FIG. 1). For instance, the front face 214 may engage the movable guard 140 (FIG. 1) during the mating operation. The front face 214 may also be referred to as a front wall.

The connector housing 204 includes an array 206 of passages 208, 209 that open to the front face 214. The electrical connector 106 may include one or more electrical contacts coupled to the connector body 202 and, in particular, the connector housing 204. For example, the electrical connector 106 may include an array of electrical contacts, such as the electrical contacts 521 shown in FIG. 9. The passages 208, 209 may include respective electrical contacts. Although the illustrated embodiment illustrates passages 208, 209 where the electrical contacts may be located, other embodiments may include electrical contacts having elongated bodies that are exposed to an exterior. Such electrical contacts may be similar to the electrical contacts 132, 133 (FIG. 1).

The connector body 202 and the electrical connector 100 (FIG. 1) are configured to align with the alignment axis 191 and/or the alignment axis 291 and move relatively along the alignment axis toward each other during the mating operation. For example, the electrical connector 106 may move toward the electrical connector 100, the electrical connector 100 may move toward the electrical connector 106, or the electrical connectors 100, 106 may move toward each other during the mating operation.

The electrical connector 106 also includes a seal gland 220 that is secured to the connector body 202. The seal gland 220 includes a material (e.g., elastomer, such as silicone rubber or other material having a similar flexibility, compressibility, tear strength, etc.) that is configured to be displaced (e.g., flexed and/or compressed) during the mating operation while maintaining a compressive force against the other connector when the two connectors are fully mated. The seal gland 220 is shaped to engage the electrical connector 100 (FIG. 1) during the mating operation. As described herein, the seal gland 220 includes an added or lubricant or an intrinsic lubricant. During the mating operation, a portion of the lubricant may transfer from the seal gland 220 to a surface of the other connector. With the lubricant along the surface of the other connector, a subsequent portion of the seal gland may experience reduced frictional forces.

The seal gland of one or more embodiments may at least partially surround the alignment axis. For example, as shown in FIG. 3, the seal gland 220 surrounds an entirety of the axis 291 and an entirety of the connector housing 204. The seal gland 220 may form a flange or a radially-extending perimeter. The seal gland 220 is proximate to the front face 214.

Figure 4:
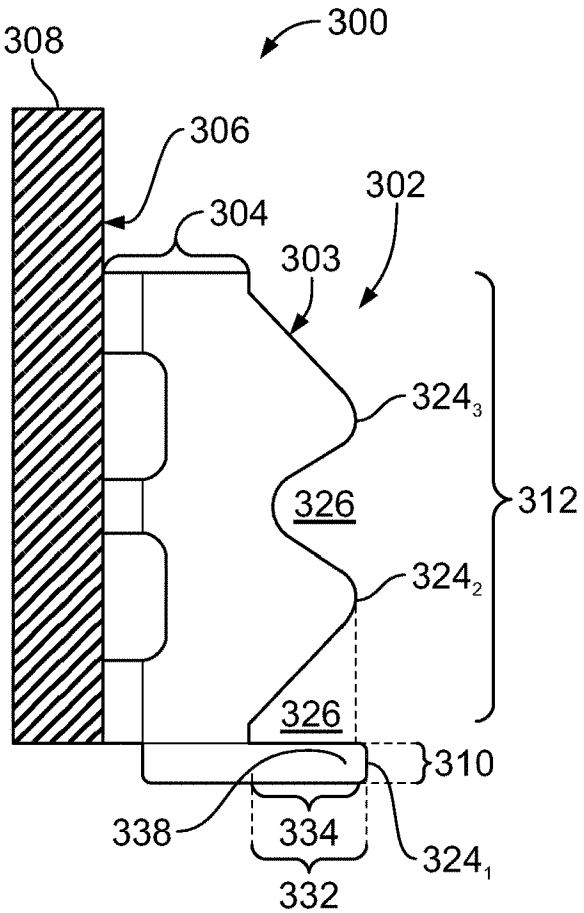
FIG. 4 is a cross-section of a portion of an electrical connector having a seal gland formed in accordance with an embodiment.

FIG. 4 is a cross-section of a portion of an electrical connector 300 having a seal gland 302. The electrical connector 300 may be similar or identical to the electrical connector 100 (FIG. 1) or the electrical connector 106 (FIG. 1). As shown, the seal gland 302 includes a base section 304 that is secured directly to a surface 306 of a connector housing 308. The seal gland 302 may be secured to the surface 306 using an adhesive. Alternatively, the seal gland 302 may be molded with the connector housing 308. The seal gland 302 may also be a discrete component that is attached to the connector housing 308 through an interference fit.

The seal gland 302 includes a lubricating section 310 and a sealing section 312. Each of the lubricating section 310 and the sealing section 312 is displaceable by an electrical connector 340 (FIG. 5) during a mating operation. In particular embodiments, the seal gland 302 includes a unitary piece of material in which the sealing section 312 and the lubricating section 310 are portions of the unitary piece of material. The lubricating section 310 may have at least one of an added lubricant or an intrinsic lubricant. Optionally, the lubricant may be intrinsic with the unitary piece of material. In such embodiments, each of the sealing section 312 and the lubricating section 310 includes the lubricant and permits the lubricant to transfer to the other surface. However, the lubricating section 310 is also configured to permit advancement of the electrical connector 340. For example, the lubricating section 310 may provide a nominal resistance that is overcome by a mating force 336 (shown in FIG. 5) for mating the electrical connectors 300 and 340. The mating force 336 may be at most 40 N or at most 30 N. In particular embodiments, the mating force 336 may be at most 25 N or at most 20 N. In more particular embodiments, the mating force 336 may be at most 15 N or at most 10 N.

Alternatively or in addition to the above, the lubricating section may be coated or sprayed with a lubricant. In such embodiments, the lubricating section may have an identical or similar shape as the lubricating section 310.

Figure 5:
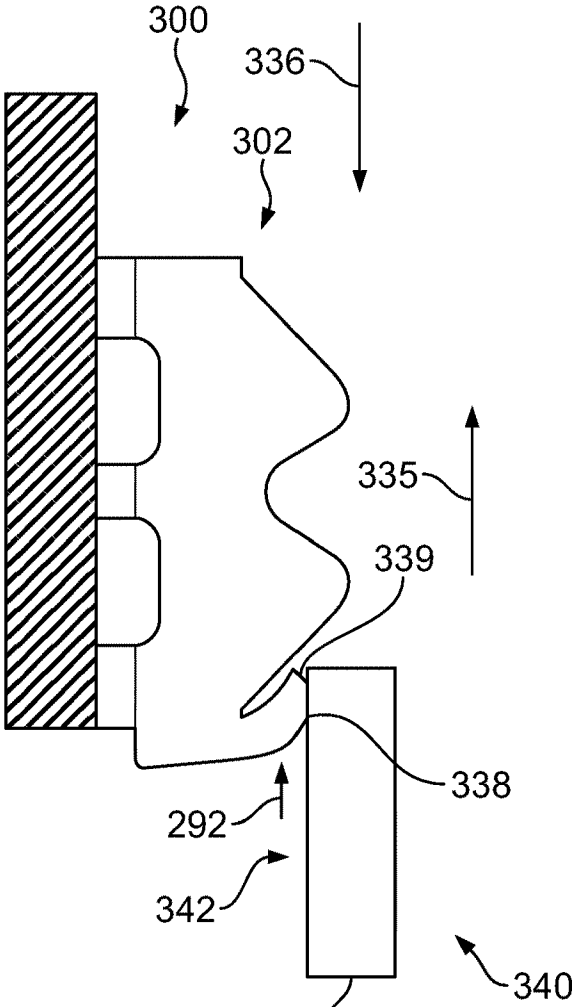
FIG. 5 is a cross-section of a portion of the electrical connector of FIG. 4 as the seal gland engages a surface of a receptacle connector.

The lubricating section 310 is positioned in front of the sealing section 312 so that the lubricating section 310 initially engages the electrical connector 340 (FIG. 5). More specifically, the lubricating section 310 is positioned to engage the electrical connector 340 before the sealing section 312 engages the electrical connector. As described herein, the seal gland 302 is configured to reduce a maximum mating force for mating the electrical connector 300 and the other electrical connector 340. For example, the seal gland 302 may provide a first frictional force 335 as the electrical connector 340 engages the lubricating section 310 and a second frictional force 337 as the electrical connector 340 engages the sealing section 312. The second frictional force 337 is greater than the first frictional force 335. In other words, the first frictional force 335, which resists movement of the electrical connectors 300, 340 toward each other during the mating operation, is generated when the lubricating section 310 and the electrical connector 340 engage each other. The second frictional force 337, which also resists movement of the electrical connectors 300, 340 toward each other during the mating operation, is generated when the sealing section 312 and the electrical connector 340 engage each other. The second frictional force 337 is greater than the first frictional force 335.

Figure 7:
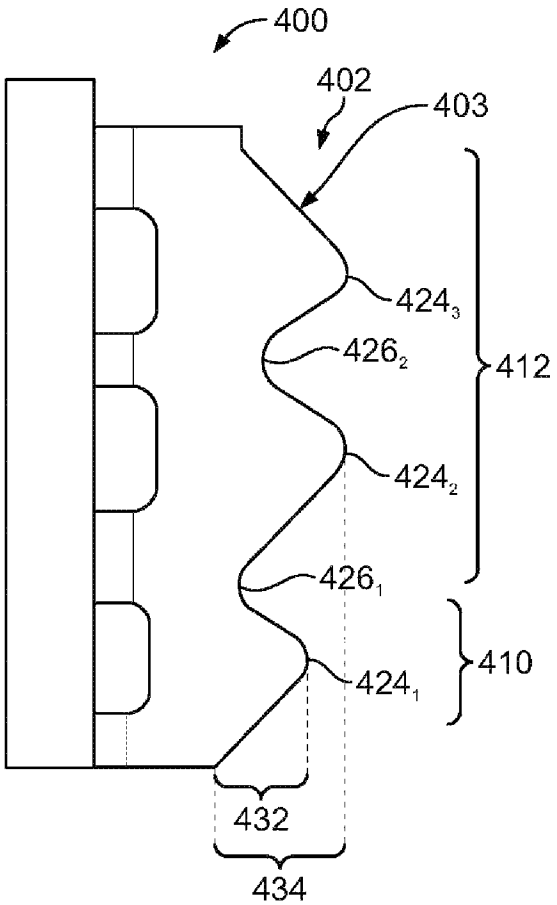
FIG. 7 is a cross-section of a portion of an electrical connector having a seal gland formed in accordance with an embodiment.

In some embodiments, the seal gland 302 includes a series of alternating ridges $\mathbf{324_1}$-$\mathbf{324_3}$ and grooves $\mathbf{326_1}$-$\mathbf{326_2}$. The seal gland 302 has an exterior gland surface 303 that is contoured to define the alternating ridges $\mathbf{324_1}$-$\mathbf{324_3}$ and grooves $\mathbf{326_1}$-$\mathbf{326_2}$. The grooves $\mathbf{326_1}$-$\mathbf{326_2}$ are voids along the seal gland 302 that enable the ridges $\mathbf{324_1}$-$\mathbf{324_3}$ to be more easily displaced (e.g., flexed or compressed). The ridges $\mathbf{324_1}$-$\mathbf{324_3}$ may have a similar shape (as shown in FIG. 7) or may have different shapes. For example, FIG. 4 illustrates the lubricating section 310 includes a leading ridge $\mathbf{324_1}$ of the series of alternating ridges $\mathbf{324_1}$-$\mathbf{324_3}$ and grooves $\mathbf{326_1}$-$\mathbf{326_2}$. The sealing section 312 includes an interior ridge $\mathbf{324_2}$ of the series of alternating ridges $\mathbf{324_1}$-$\mathbf{324_3}$ and grooves $\mathbf{326_1}$-$\mathbf{326_2}$. The leading ridge $\mathbf{324_1}$ and the interior ridge $\mathbf{324_2}$ are adjacent to each other with one of the grooves $\mathbf{326_1}$ therebetween.

Also shown in FIG. 4, the leading ridge $\mathbf{324_1}$ has a radial height 332 that is greater than a radial height 334 of the interior ridge $\mathbf{324_2}$. In particular embodiments, the leading ridge $\mathbf{324_1}$ forms a part of a gland finger 338 that extends away from the surface 306.

FIG. 5 is a cross-section of a portion of the electrical connector 300 as the seal gland 302 engages a surface 342 of an electrical connector 340. The surface 342 may be an interior or an exterior surface of a connector body or a connector housing. The gland finger 338 is deflectable in a direction 292 that is at least partially along the alignment axis 291 (FIG. 3) such that a distal end or tip 339 of the gland finger 338 is displaced at least partially along the alignment axis 291.

During the mating operation, a connector housing 341 of the electrical connector 340 engages the gland finger 338. An end portion of the gland finger 338 is displaced in the direction 292. More specifically, the distal end 339 is deflected partially along the alignment axis 291 (FIG. 3) and partially toward the surface 306 of the connector housing 308.

Figure 6:
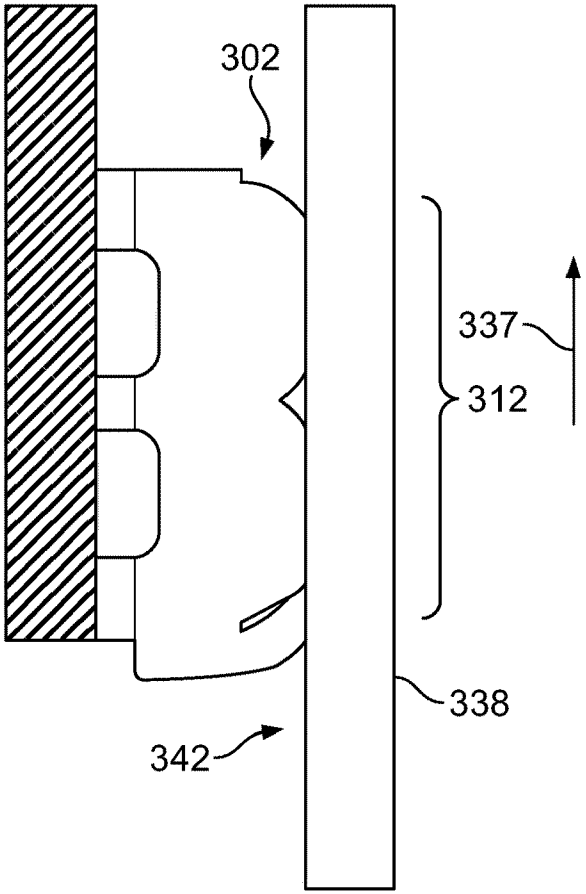
FIG. 6 is a cross-section of a portion of an electrical connector assembly that includes the electrical connector of FIG. 4 and the corresponding receptacle connector fully mated.

As shown in FIG. 5, the seal gland 302 is engaging the surface 342 and sliding along the surface 342. Because the gland finger 338 is shaped to more easily yield during the mating operation, the mating force for engaging the two connectors is reduced. Nonetheless, the seal gland 302 wipes along the surface 342 and transfers lubricant (not shown)

onto the surface 342. Accordingly, prior to the surface 342 engaging the sealing section 312 of the seal gland 302, the lubricant is disposed along the surface 342. When the surface 342 engages the sealing section 312 (as shown in FIG. 6), the frictional forces generated between the seal gland 302 and the surface 342 are reduced.

Figure 8:
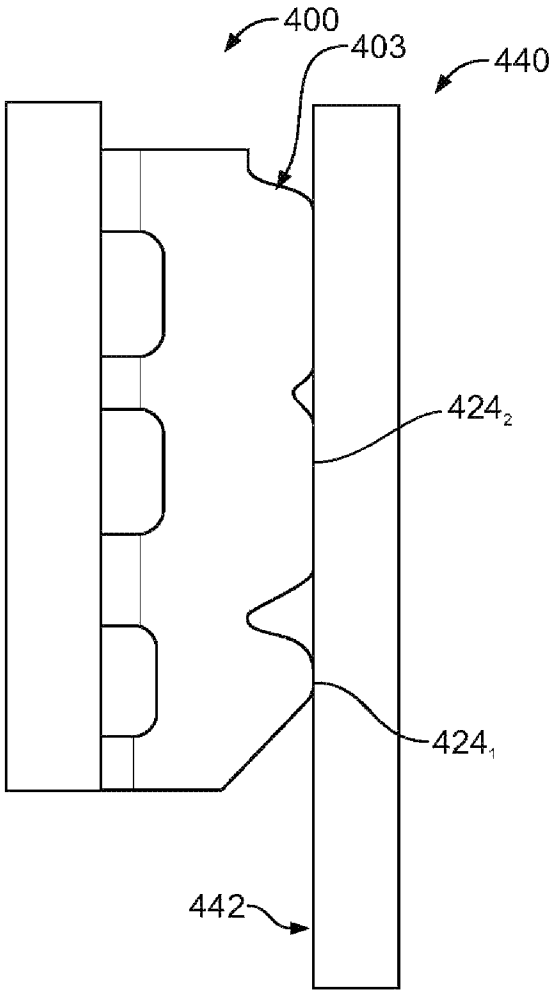
FIG. 8 is a cross-section of a portion of an electrical connector assembly that includes the electrical connector of FIG. 7 and the corresponding receptacle connector fully mated.

FIGS. 7 and 8 are cross-sections of a portion of an electrical connector 400 having a seal gland 402 that includes a sealing section 412 and a lubricant section 410. As shown, the seal gland 402 includes a series of alternating ridges $\mathbf{424}_1$-$\mathbf{424}_3$ and grooves $\mathbf{426}_1$-$\mathbf{426}_2$. The seal gland 402 has an exterior gland surface 403 that is contoured to define the alternating ridges $\mathbf{424}_1$-$\mathbf{424}_3$ and grooves $\mathbf{426}_1$-$\mathbf{426}_2$. The grooves $\mathbf{426}_1$-$\mathbf{426}_2$ are voids along the seal gland 402 that enable the ridges $\mathbf{424}_1$-$\mathbf{424}_3$ to be more easily displaced (e.g., flexed or compressed). The ridges $\mathbf{424}_1$-$\mathbf{424}_3$ may have a similar shape (as shown) or may have different shapes.

As shown, FIG. 7 illustrates the lubricating section 410 including a leading ridge $\mathbf{424}_1$ of the series of alternating ridges $\mathbf{424}_1$-$\mathbf{424}_3$ and grooves $\mathbf{426}_1$-$\mathbf{426}_2$. The sealing section 412 includes interior ridges $\mathbf{424}_1$-$\mathbf{424}_3$ of the series of alternating ridges $\mathbf{424}_1$-$\mathbf{424}_3$ and grooves $\mathbf{426}_1$-$\mathbf{426}_2$. The leading ridge $\mathbf{424}_1$ and the interior ridge $\mathbf{424}_2$ are adjacent to each other with one of the grooves $\mathbf{426}_1$ therebetween.

The leading ridge $\mathbf{424}_1$ and the interior ridge $\mathbf{424}_2$ having similar shapes. The leading ridge $\mathbf{424}_1$, however, has a radial height 432 that is less than a radial height 434 of the interior ridge $\mathbf{424}_2$. During the mating operation, the frictional forces generated between the leading ridge $\mathbf{424}_1$ and a surface 442 of an electrical connector 440 are less than the frictional forces generated between the interior ridge $\mathbf{424}_2$ and the surface 442 of an electrical connector 440. Due to the radial height 432, the area of the surface 442 that engages the leading ridge $\mathbf{424}_1$ is reduced. Moreover, the leading ridge $\mathbf{424}_1$ is compressed less than the interior ridge $\mathbf{424}_2$. As such, the forces pressing the surface 403 and the surface 442 toward each other are reduced, thereby also reducing a magnitude of the frictional forces.

In FIGS. 4-8, the seal gland appears as a single part having the sealing section and the lubricating section coupled to each other. In other embodiments, the seal gland may include separate sections. For example, the lubricating section may be similar to the lubricating section 310 shown in FIG. 4 or the lubricating section 410 shown in FIG. 7. However, a gap or space may separate the lubricating section from the sealing section such that the lubricating section and the sealing section are separate and discrete parts that form the seal gland. The sealing section may be similar to the sealing section 312 shown in FIG. 4 or the sealing section 412 shown in FIG. 7. However, the sealing section may be spaced apart from the lubricating section. For instance, a portion of the surface of the connector body to which the lubricating and sealing sections are attached may be extend between the separate lubricating and sealing sections.

Figure 9:
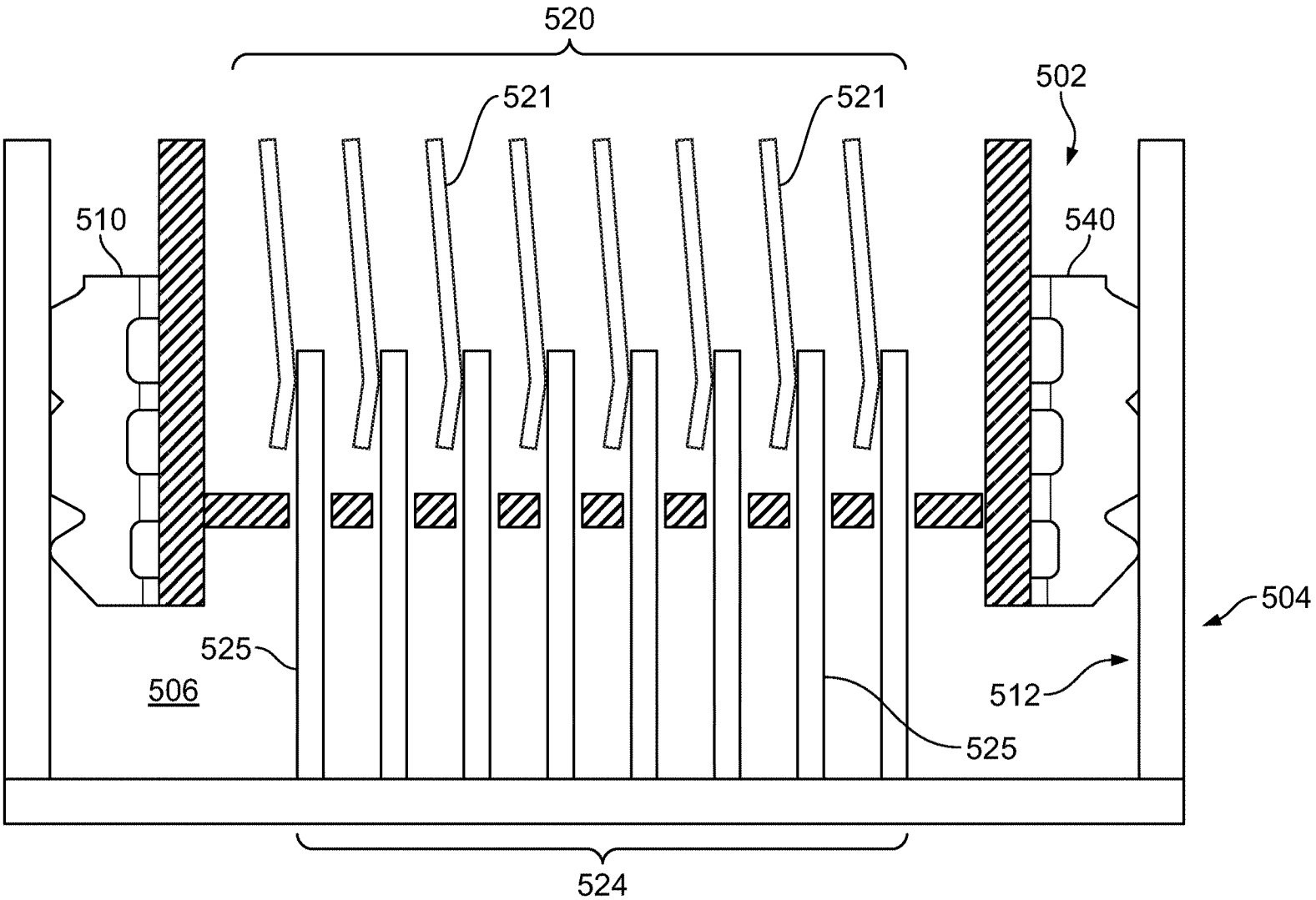
FIG. 9 is a cross-section of an electrical connector assembly formed in accordance with an embodiment in which frictional forces for mating the electrical connector and the receptacle connector occur at different stages.

FIG. 9 is a cross-section of an electrical connector assembly 500 formed in accordance with an embodiment. The electrical connector assembly 500 includes an electrical connector 502 and an electrical connector 504. The electrical connector 502 is a header connector, and the electrical connector 504 is a receptacle connector. The electrical connector 502 includes a contact array 520 of electrical contacts 521 (or beam contacts), and the electrical connector 504 includes an array 524 of electrical contacts 525 (or pin contacts). As shown, a portion of the electrical connector 502 is disposed within a cavity 506 of the electrical connector 504. The electrical connector 502 includes seal glands 510, 511 that engage an interior surface 512 of the electrical connector 504.

Optionally, in some embodiments, the electrical connectors 502 and 504 may be configured to stage the frictional forces to reduce or control the maximum mating force. For example, the seal glands 510, 511 and the electrical contacts 521 and the electrical contacts 525 may be sized, shaped, and positioned so that frictional forces between the seal glands 510, 511 and the interior surface 512 may occur during a first stage of the mating operation. Frictional forces between the electrical contacts 521 and the respective electrical contacts 525 may occur during a second stage.

Figure 10:
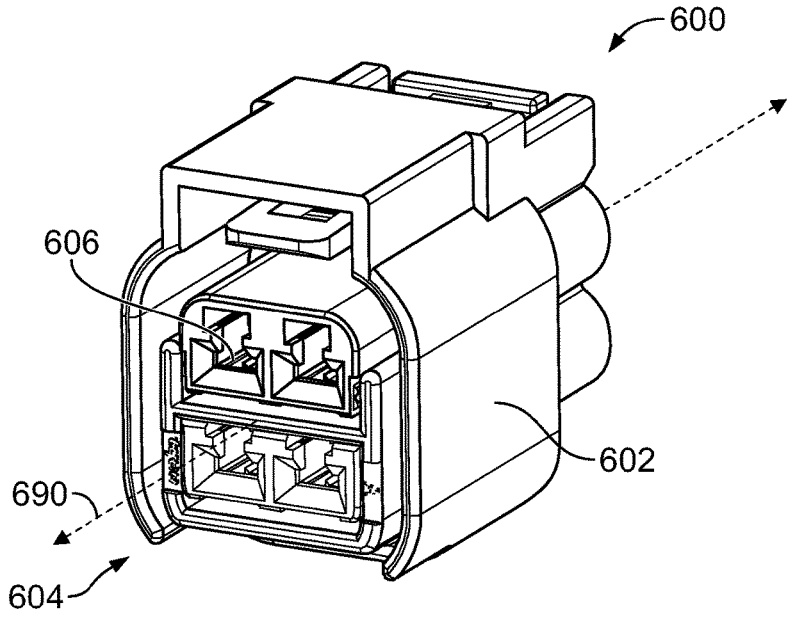
FIG. 10 is a perspective view of an electrical connector formed in accordance with an embodiment.
Figure 11:
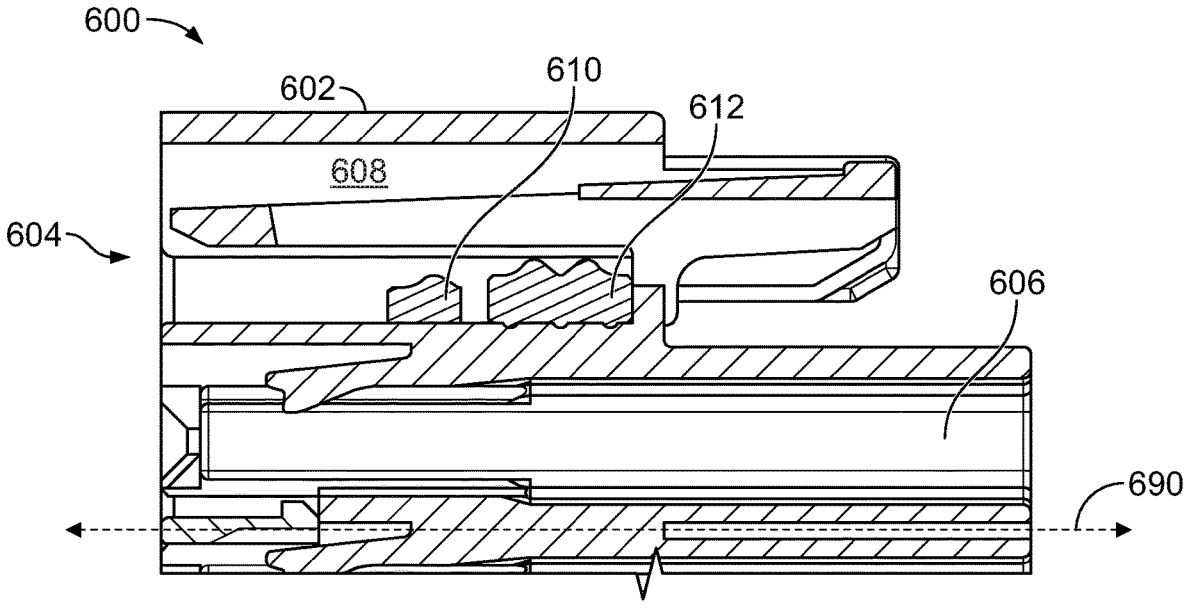
FIG. 11 is a cross-section of a portion of the electrical connector of FIG. 10 having a seal gland formed in accordance with an embodiment.

FIGS. 10 and 11 show a perspective view and a portion of a cross-section of an electrical connector 600 formed in accordance with an embodiment. The electrical connector 600 may include features that are similar or identical to features of the electrical connectors 106 (FIG. 1), 300 (FIG. 4), 400 (FIG. 7), and 502 (FIG. 9). For example, the electrical connector 600 includes a connector body 602 having a leading end 604 that is configured to mate with a mating connector (not shown). The connector body 602 and the mating connector are configured to align with an alignment axis 690 and move relatively along the alignment axis 690 toward each other during a mating operation.

The electrical connector 600 also includes a plurality of electrical contacts 606 that coupled to the connector body 602 and configured to engage a respective contact (not shown) of the mating connector during the mating operation. In FIG. 10, the electrical connector 600 has multiple electrical contacts 606. In other embodiments, however, the electrical connector 600 may include only a single electrical contact 606.

As shown in FIG. 11, the electrical connector 600 also includes a seal gland 608 that is secured to the connector body 602. The seal gland 608 is shaped to engage the mating connector during the mating operation. The seal gland 608 includes a lubricating section 610 and a sealing section 612. The seal gland 608 is disposed within an interior of the electrical connector 600 and extends away from an interior surface of the connector body 602.

Each of the lubricating and sealing sections 610, 612 are displaceable by the mating connector during the mating operation. The lubricating section 610 is positioned in front of the sealing section 612 such that the lubricating section 610 initially engages the mating connector. As described herein, the lubricating section 610 may have at least one of an added lubricant or an intrinsic lubricant. Optionally, the sealing section 612 includes an added lubricant or an intrinsic lubricant. Optionally, the lubricating section 610 includes an added lubricant, but the sealing section 612 does not include an added lubricant. The sealing section 612 may include an intrinsic lubricant or be devoid of a lubricant.

In the illustrated embodiment, the lubricating and sealing sections 610, 612 are spaced apart from one another. Similar to the other seal glands described herein, the seal gland 608 is configured to provide a first frictional force as the mating connector engages the lubricating section 610 and a second frictional force as the mating connector engages the sealing section 612. The second frictional force is greater than the first frictional force.

Although embodiments are shown and described as one of the mated electrical connectors having a seal gland, it should be understood that each of the electrical connectors may include a seal gland.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a connector body having a leading end that is configured to mate with a mating connector, the connector body and the mating connector configured to align with an alignment axis and move relatively along the alignment axis toward each other during a mating operation;

an electrical contact coupled to the connector body and configured to engage a respective contact of the mating connector during the mating operation; and a seal gland secured to the connector body, the seal gland being shaped to engage the mating connector during the mating operation, wherein the seal gland includes a lubricating section and a sealing section that are displaceable by the mating connector during the mating operation, the lubricating section being positioned in front of the sealing section such that the lubricating section initially engages the mating connector, the lubricating section having at least one of an added lubricant or an intrinsic lubricant, wherein the seal gland is configured to provide a first frictional force as the mating connector engages the lubricating section and a second frictional force as the mating connector engages the sealing section, the second frictional force being greater than the first frictional force;

wherein the lubricating section and the sealing section are configured such that the lubricating section, relative to the sealing section, at least one of is more easily flexed along the alignment axis during the mating operation, is more easily compressed during the mating operation, or has less area that engages the mating connector during the mating operation.

2. The electrical connector of claim 1, further comprising a contact array that includes the electrical contact and additional electrical contacts.

3. The electrical connector of claim 1, wherein the lubricating section includes a gland finger that extends away from a surface of the connector body and defines a leading ridge, the gland finger being deflectable in a direction at least partially along the alignment axis such that the leading ridge is displaced at least partially along the alignment axis.

4. The electrical connector of claim 1, wherein the electrical connector is devoid of an integrated tool for driving the mating operation.

5. The electrical connector of claim 1, wherein the lubricating section has an engagement surface that engages the mating connector and the electrical contact has an engagement surface that engages the mating connector, the engagement surface of the lubricating section being positioned in front of the engagement surface of the electrical contact.

6. The electrical connector of claim 1, wherein a maximum mating force for mating the mating connector and the electrical connector having the seal gland is less than a maximum mating force for mating the mating connector and the electrical connector devoid of the lubricating section.

7. The electrical connector of claim 1, wherein the electrical connector is a high-voltage connector having an operating voltage of at least 48 volts (V).

8. The electrical connector of claim 1, wherein the lubricating section includes a leading ridge and the sealing section includes an interior ridge, the leading ridge having a radial height that is greater than a radial height of the interior ridge.

9. The electrical connector of claim 1, wherein the lubricating section and the sealing section are configured such that the lubricating section, relative to the sealing section, is at least one of more easily flexed along the alignment axis during the mating operation or more easily compressed during the mating operation.

10. The electrical connector of claim 1, wherein the lubricating section includes a leading ridge having a first dimension along the alignment axis and the sealing section includes an interior ridge having a second dimension along the alignment axis, the first dimension being less than the second dimension.

11. The electrical connector of claim 1, wherein the seal gland includes a series of alternating ridges and grooves.

12. The electrical connector of claim 11, wherein the lubricating section includes a leading ridge of the series of alternating ridges and grooves and the sealing section includes an interior ridge of the series of alternating ridges and grooves, the leading ridge and the interior ridge being adjacent to each other with one of the grooves therebetween, wherein the leading ridge has a radial height that is less than a radial height of the interior ridge.

13. The electrical connector of claim 11, wherein the seal gland is disposed along an exterior of the electrical connector and extends away from a surface of the connector body.

14. The electrical connector of claim 1, wherein the seal gland includes a unitary piece of material in which the sealing section and the lubricating section are portions of the unitary piece of material, wherein the sealing section has at least one of the added lubricant or the intrinsic lubricant.

15. The electrical connector of claim 14, wherein the lubricant is intrinsic with the unitary piece of material.

16. An electrical connector assembly comprising:

an electrical connector including a connector body having a leading end and an electrical contact coupled to the connector body;

a mating connector configured to mate with the electrical connector such that the electrical contact and a respective contact of the mating connector engage each other during a mating operation, wherein the connector body and the mating connector are configured to align with an alignment axis and move relatively along the alignment axis toward each other during the mating operation; and a seal gland disposed between respective surfaces of the electrical connector and the mating connector when fully mated, wherein the seal gland includes a lubricating section and a sealing section that are displaceable during the mating operation, the lubricating section being positioned in front of the sealing section such that the lubricating section is displaced prior to the sealing section being displaced during the mating operation, the lubricating section having at least one of an added lubricant or an intrinsic lubricant, wherein the lubricating section reduces a maximum mating force for mating the mating connector and the electrical connector;

wherein the lubricating section and the sealing section are configured such that the lubricating section, relative to the sealing section, at least one of is more easily flexed along the alignment axis during the mating operation, is more easily compressed during the mating operation, or has less area that engages one of the respective surfaces during the mating operation.

17. The electrical connector assembly of claim 16, wherein a maximum mating force during the mating operation is at most 75 newtons (N).

18. The electrical connector assembly of claim 16, wherein the lubricating section includes a gland finger that extends away from a surface of the connector body and defines a leading ridge, the gland finger being deflectable in a direction at least partially along the alignment axis such that the ridge is displaced at least partially along the alignment axis.

19. The electrical connector assembly of claim 16, wherein the seal gland includes a series of alternating ridges and grooves.

20. The electrical connector assembly of claim 19, wherein the lubricating section includes a leading ridge of the series of alternating ridges and grooves and the sealing section includes an interior ridge of the series of alternating ridges and grooves, the leading ridge and the interior ridge being adjacent to each other with one of the grooves therebetween, wherein the leading ridge has a radial height that is less than a radial height of the interior ridge.

21. The electrical connector assembly of claim 19, wherein the seal gland is disposed along an exterior of the electrical connector and extends away from a surface of the connector body.

* * * * *